US009181650B2

(12) United States Patent
D'Andrea et al.

(10) Patent No.: US 9,181,650 B2
(45) Date of Patent: Nov. 10, 2015

(54) WASHING MACHINE EQUIPPED WITH BULK TANKS

(75) Inventors: Luca D'Andrea, Naples (IT); Giovanni Bombardieri, Albino (IT); Gianluca Pierucci, Moie (IT); Maurizio Baldini, Fabriano (IT); Rodolfo Flumini, Fabriano (IT); Constantino Mariotti, Sigillo (IT); Fernanda Gaggioli, legal representative, Sigillo (IT); Maria Angela Mariotti, legal representative, Sigillo (IT); Elisa Mariotti, legal representative, Sigillo (IT)

(73) Assignee: INDESIT COMPANY S.P.A., Fabriano (IT)

( * ) Notice: Subject to any disclaimer, the term of this patent is extended or adjusted under 35 U.S.C. 154(b) by 626 days.

(21) Appl. No.: 13/055,799

(22) PCT Filed: Jun. 9, 2009

(86) PCT No.: PCT/IB2009/005892

§ 371 (c)(1),
(2), (4) Date: Mar. 2, 2011

(87) PCT Pub. No.: WO2010/013101

PCT Pub. Date: Feb. 4, 2010

(65) Prior Publication Data

US 2011/0185773 A1 Aug. 4, 2011

(30) Foreign Application Priority Data

Jul. 28, 2008 (IT) ..... TO2008A0577

(51) Int. Cl.

| | |
|---|---|
| ***D06F 35/00*** | (2006.01) |
| ***D06F 39/02*** | (2006.01) |
| ***A47L 15/44*** | (2006.01) |

(52) U.S. Cl.

CPC ..... *D06F 39/022* (2013.01); *A47L 15/4418* (2013.01)

(58) Field of Classification Search

CPC ..... D06F 39/02; D06F 39/022; D06F 39/028; A47L 15/4418

USPC ..... 68/17 R, 902

See application file for complete search history.

(56) References Cited

U.S. PATENT DOCUMENTS

| | | | | |
|---|---|---|---|---|
| 4,168,615 | A * | 9/1979 | Condit | 68/207 |
| 4,503,575 | A * | 3/1985 | Knoop et al. | 8/158 |
| 4,776,559 | A * | 10/1988 | Fornasari | 251/11 |
| 5,241,843 | A * | 9/1993 | Hein | 68/3 R |
| 5,345,637 | A * | 9/1994 | Pastryk et al. | 8/158 |
| 5,606,878 | A * | 3/1997 | Arreghini et al. | 68/17 R |
| 5,897,672 | A * | 4/1999 | Badami et al. | 8/159 |
| 2007/0261177 | A1* | 11/2007 | Risen et al. | 8/158 |

FOREIGN PATENT DOCUMENTS

| | | |
|---|---|---|
| EP | 0379950 | 1/1990 |
| EP | 0582329 B1 | 9/1994 |
| EP | 1688529 A | 9/2006 |
| GB | 2214524 B | 11/1991 |
| WO | WO/2008/080789 | 7/2008 |

* cited by examiner

*Primary Examiner* — David Cormier
(74) *Attorney, Agent, or Firm* — Cesari and McKenna, LLP

(57) ABSTRACT

A washing machine, such as a laundry washing machine, a washing/drying machine or the like, has a tub housing a drum into which the laundry to be washed is loaded. The machine is equipped with at least one tank for a washing agent, and at least one supply duct is afferent to the tank for delivering the washing agent into the tub. A hydraulic washing circuit floods and drains the tank for cleaning purpose. A tank cleaning method is also disclosed.

15 Claims, 3 Drawing Sheets

WASHING MACHINE EQUIPPED WITH BULK TANKS

RELATED APPLICATIONS

The present application is a 371 Application of International Application No. PCT/IB2009/005892 filed Jun. 9, 2009 by Indesit Company S.P.A. for a WASHING MACHINE EQUIPPED WITH BULK TANKS, which claims priority to Italian Application No. TO2008A000577 filed Jul. 28, 2008, both of which are hereby incorporated by reference in their entirety.

BACKGROUND OF INVENTION

1. Field of the Invention

The present invention relates to a washing machine equipped with bulk tanks according to the preamble of the first claim.

Washing machines, such as laundry washing or washing/drying machines, are currently available which are equipped with tanks containing sufficient quantities of washing agents, e.g. detergents, softeners or the like, that do not require the user to refill the machine before every working cycle; for this purpose, these tanks are usually arranged in the lower part of the machine and have volumes such that they can contain sufficient quantities of washing agent for several working cycles of the machine; for this reason they are called "bulk tanks".

2. The Prior Art

Tanks of the above-mentioned type are described, for example, in British patent GB 2 214 524 in the name of INDUSTRIE ZANUSSI S.p.A., and are provided in the form of disposable bags made of deformable plastic which are positioned on the bottom of the washing machine and which supply the tub supply feedbox as necessary. Once exhausted, said bags are replaced with new bags. The cost of bag replacement, however, must be added to the cost of the washing agent, and therefore this solution cannot be considered to be optimal.

For this reason, other types of tanks have been conceived which are rigid containers secured to the bottom of the washing machine, e.g. like those described in European patent EP 0 379 950 in the name of MIELE & Cie GmbH, which are gradually emptied as the washing agent is supplied to the tub.

These tanks are normally filled up before having become completely empty, in order to avoid the risk that a wash cycle is carried out without washing agent.

However, this solution is affected by the problem that the prolonged presence of washing agent in the tank may cause scale and dirt build-up, thus jeopardizing the correct operation of the washing machine.

Rigid tanks suffer from this drawback, unlike disposable bags, which are not affected by this problem because once exhausted they are replaced with new ones.

It follows that a user wanting to clean the rigid tank will be compelled to remove it beforehand from its housing in the machine. This task is not easily done, and implies that the tank must have certain characteristics: first of all, the connections between the tank and the washing machine (e.g. the washing agent supply ducts) must be removable; secondly, the tank must be mounted in the front of the machine, and its shape and extension must be such as to allow it to be removed and re-inserted into its housing; in this respect, it should be noted that the front dimension of the machine is partially occupied by the drum, and therefore the size of the rigid tank known in the art, when removable, cannot be very big; it follows that a removable tank will have a reduced capacity.

SUMMARY OF THE INVENTION

It is a first object of the present invention to provide a washing machine equipped with at least one bulk tank which can overcome the above-mentioned drawbacks by using a tank that can be easily cleaned without requiring complex tank removal tasks or affecting the tank's capacity or shape.

Said object is achieved through a machine having the features set out in the appended first claim.

In short, the present invention is based on the idea of providing a machine equipped with a hydraulic tank washing circuit.

According to an improved embodiment, the tanks are washed by using the same process water used for the wash cycle.

The present invention also relates to a method for cleaning a washing agent tank according to the appended independent method claim.

Other advantageous features will be set out in the appended claims, which are intended as an integral part of the present text.

These features as well as further advantages of the present invention will become apparent from the following description of an embodiment thereof as shown in the annexed drawings, which are supplied by way of non-limiting example.

DESCRIPTION OF THE PREFERRED EMBODIMENTS

Figure 1:
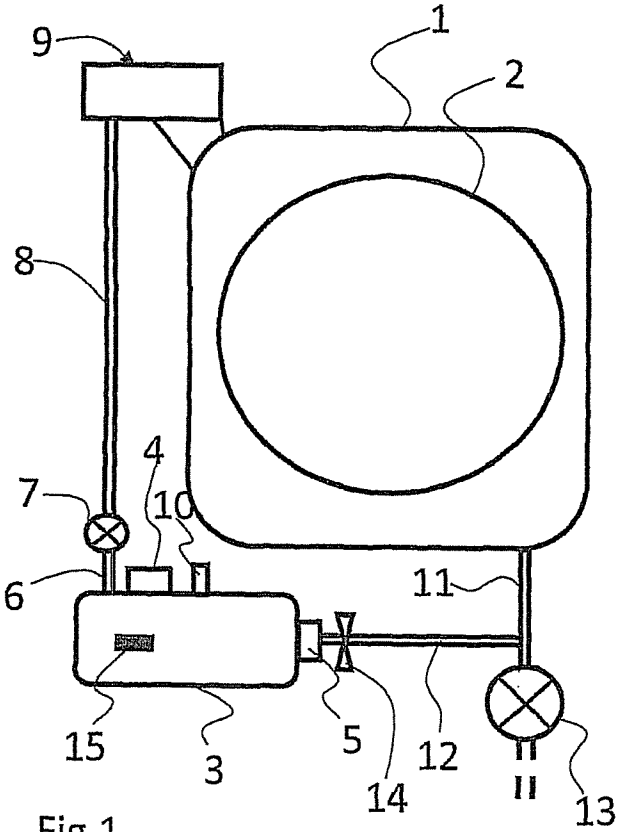
FIG. 1 shows a diagram of the hydraulic system for cleaning a washing agent tank according to the present invention.

Referring now to FIG. 1, it diagrammatically shows the details of a washing machine which are involved in the present invention.

In particular, the drawing shows: a tub 1 housing a rotary drum 2 in which the laundry to be washed is placed, and a washing agent tank 3 capable of containing a quantity of washing agent larger than needed for one working cycle of the machine.

Tank 3 is fitted with a filler port 4, a cleaning port 5, and a supply duct 6 connected to a suction pump 7 and through this to a feedbox 9 by means of a supply duct 8; filler port 4 is connected through a duct (not shown) to a filler mouth obtained, for example, on a dispenser of the machine, e.g. a filler mouth afferent to a dispenser drawer.

The tank also has an air intake 10 which puts it in communication with the atmosphere, so that it is gradually filled with air as the washing agent is being used, thus preventing any vacuum; air intake 10 also works as an air vent when the tanks are filled.

Air intake 10 is usually arranged in fluid communication with a washing agent dispenser of the machine, such as a dispenser drawer or a feedbox, so that any washing agent accidentally leaking therefrom will not disperse into the environment.

FIG. 1 also shows drain duct 11 for draining the water from tub 1, from which branch duct 12 extends towards cleaning port 5; branch duct 12 is typically connected to drain duct 11 upstream of drain pump 13, which is typically a volumetric pump, which drains the water into the drain system (indicated by a dashed line).

It should be pointed out that cleaning port 5 can be opened or closed through valve 14, as will be explained in detail hereafter.

Within the tank there is a level sensor 15 adapted to detect the level variations of the washing agent in tank 3.

The system operates as follows: tank 3 is filled through filler port 4 with a preferred washing agent, e.g. a detergent, a softener or the like, with valve 14 closed, so as to prevent the washing agent from flowing towards the pump along branch duct 12.

During the working cycle of the washing machine, water is supplied from feedbox 9 or, as an alternative, through a suitable duct afferent to the tub (not shown), and a certain quantity of washing agent is taken from tank 3 by means of suction pump 7. The washing agent then flows through supply ducts 6 and 8 (upstream and downstream of the suction pump, respectively) up to supply feedbox 9, from which it is delivered into tub 1 and used for washing the laundry.

During the working cycle of the washing machine, the rinse water (containing the washing agent and any dirt particles removed from the laundry) is drained through duct 11 and drain pump 13 into the drain system.

The volume of tank 3 is such as to contain a quantity of washing agent sufficient for several working cycles of the washing machine. As working cycles are being carried out in succession by the machine, the quantity of washing agent in tank 3 decreases and is replaced by air at ambient pressure coming in from intake 10.

During that machine working cycle in which sensor 15 signals that tank 3 is about to become completely empty, volumetric pump 13 is turned off and valve 14 opens. The water contained in tub 1 thus floods tank 3 through branch duct 12 arranged upstream of the pump, also because volumetric pump 13, when off, stops the fluid flow towards the drain (de facto acting as a valve).

Being located in the lowest part of the washing machine, tank 3 is therefore flooded with water coming from tub 1.

Incidentally, it should be noted that, for the purpose of preventing any water leakage, air intake 10 communicates with the environment at a height equal to or higher than that of the tub.

The flooding of tank 3 is detected by sensor 15, which also detects the instant when it is full of water.

In this regard, it should be mentioned that, alternatively, it would be sufficient to wait for a time long enough for the tank to become flooded, without having to use a sensor 15 also capable of detecting when the tank is full. According to this alternative, for example, the system includes a timer and the user has to issue a manual command when the tank is empty, which condition may be observed, for instance, through a transparent window provided in the tank walls, through which the user can see the remaining washing agent level in the tank.

When tank 3 is completely flooded (i.e. when sensor 15 signals that the tank is full or after enough time has elapsed), valve 14 is kept open and drain pump 13 is turned on, which removes the water from tank 3 (through same duct 12 used for filling it) and the residual water from the tub and drains it into the duct indicated by a dashed line, which is connected to the drain system.

In this regard, it should be pointed out that branch duct 12 is used for both filling and draining the tank, thus leading to a smaller number of hydraulic system components; in fact, this arrangement only requires one branch duct located upstream of the drain pump and fitted with a single valve 14, since it utilizes the volumetric drain pump as a valve (when closed).

Of course, it is alternatively conceivable to employ two dedicated ducts for filling and draining the tank, respectively, although the cost advantage of the circuit according to the present invention will thus be lost.

More in detail, the readings of sensor 15, if present, are sent to a control unit U (shown in FIG. 4 only for clarity), which then controls the opening or closing of valve 14 and drain pump 13 accordingly.

To this end, valve 14 may be a simple valve featuring a slide-type shutter controlled by an actuator: an extremely inexpensive and strong actuator type is the one known as "thermoactuator", which comprises an outer casing containing a body made of electrically and thermally conductive material (e.g. metal), connected to an electric heater; within the body, a volume is defined for a thermally expandable material (e.g. wax) operationally connected to a thrust element adapted to move a piston protruding from the outer casing; the electric heater typically consists of a positive temperature coefficient (PTC) resistor powered through two terminals.

The advantages of the present invention are therefore apparent. In the first place, an effective cleaning action is exerted on tank 3, which does not have be removed from the machine for cleaning purposes.

Furthermore, the cleaning process takes place when the tank is totally or nearly empty, e.g. during the same working cycle in which the tank becomes empty.

A further advantage is provided by the fact that, although in principle the tank might be washed with clean water, the proposed system uses rinse water which would be drained in any case, thus avoiding an unnecessary waste of water.

It is also worth mentioning that no complex parts or components are added to the hydraulic circuit of the machine, since an effective cleaning of the tank is attained through a simple and low-cost device.

An additional advantage is that the tank must not necessarily be removable, so that it can be installed fixedly in the machine, which is beneficial for construction simplicity (no removable fittings are to be provided between the tank and the afferent ducts).

Figure 3:
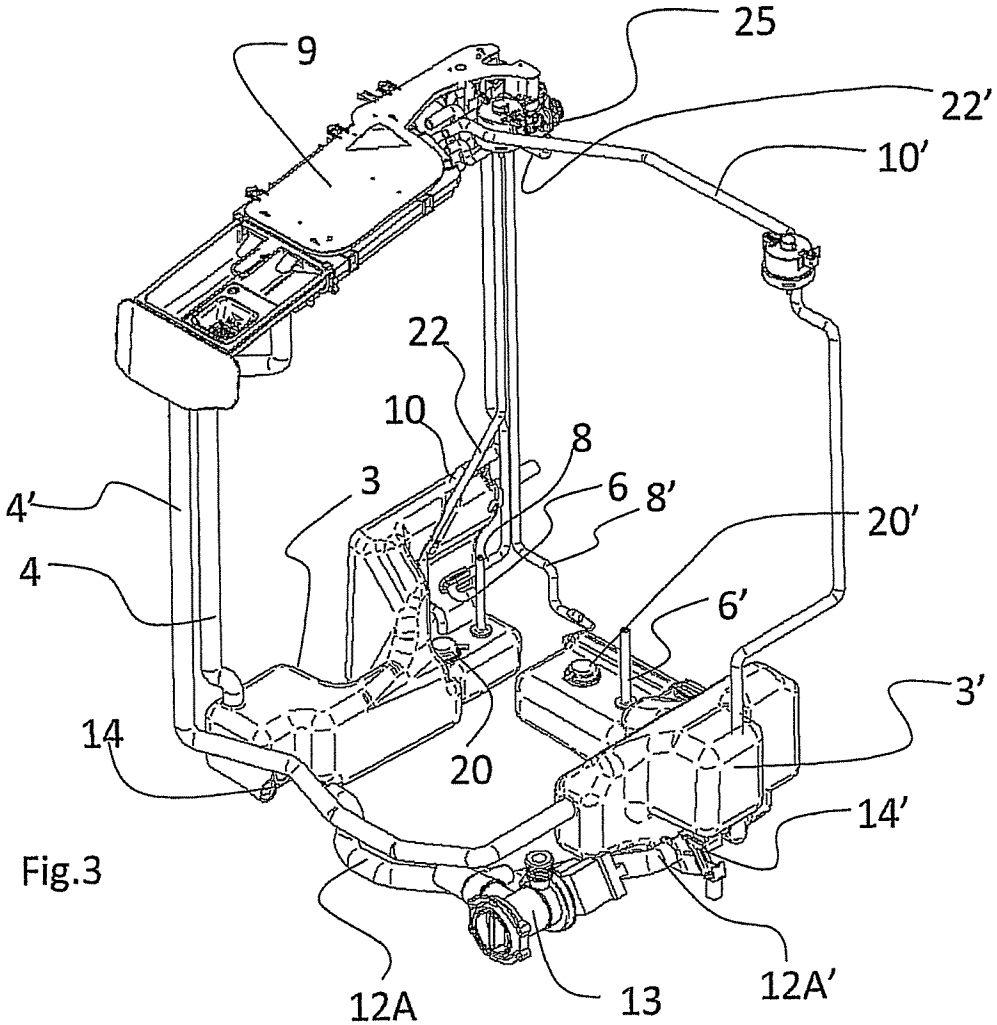
FIG. 3 shows a second variant of the diagram of FIG. 2.

Moreover, as shown in detail in FIG. 3, the tank may have any shape and may also extend rearwardly and laterally from the drum; a large capacity tank may thus be provided.

Figure 2:
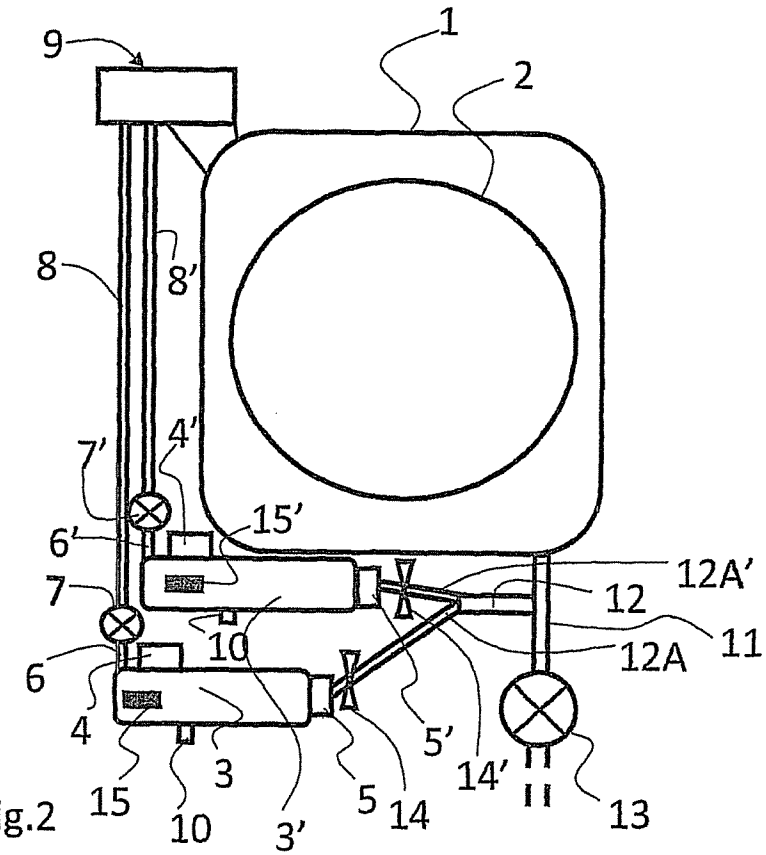
FIG. 2 shows a variant of the diagram of FIG. 1, wherein two tanks are provided.

Of course, this teaching may be subject to many variations, one of which is shown schematically in FIG. 2, wherein the same parts are designated by the same reference numerals.

This figure shows an embodiment comprising two tanks 3 and 3' (e.g. one for detergent and the other for softener) and all related parts, in analogy with FIG. 1.

Parts performing the same functions are designated by the same reference numerals followed by an apostrophe.

The operation is similar to the above, the only difference being that branch duct 12 splits into two branches 12A' and 12A, each afferent to a respective tank 3' or 3.

Of course, the consumption of the washing agents contained in tanks 3 and 3' may differ, and it may happen that one tank becomes empty earlier than the other.

In this case, since each tank 3, 3' is fitted with a sensor 15, 15', the control unit U can initiate the flooding, i.e. the cleaning, of the exhausted tank by simply keeping closed valve 14 or 14' of the tank which is not yet empty.

In this regard, it is useful to consider a further advantage of the present invention, which is related to the fact that, in the event that a user fills by mistake one or both tanks with an undesired washing agent, the tanks can be cleaned ahead of time. For example, there may be a tank cleaning/washing push-button which the user can press when he/she wants to carry out an early cleaning, e.g. if he/she realizes that an undesired washing agent has been poured in: in this case, the tanks (or even just one of them) are flooded and emptied as described above in order to remove the washing agent, thus remaining empty and clean.

FIG. 3 shows a perspective view of the hydraulic circuit shown in FIG. 2, wherein the same parts are designated by the same reference numerals.

Figure 4:
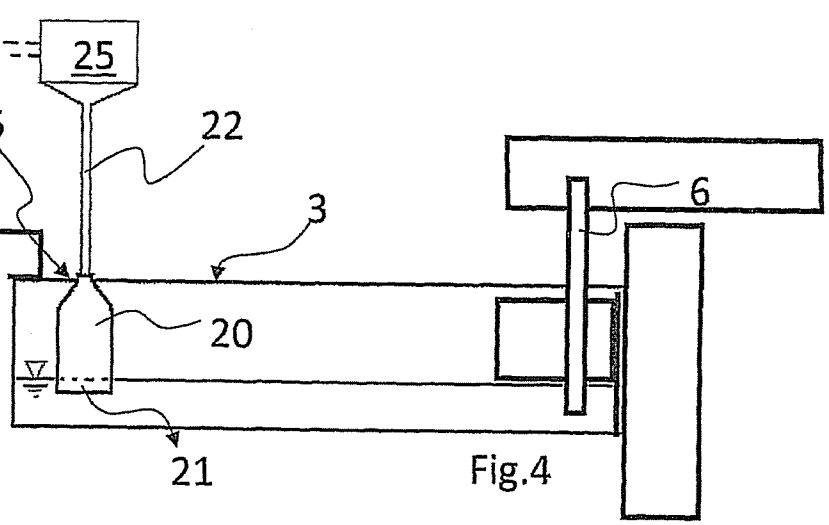
FIGS. 4 and 5 are diagrammatic views showing certain aspects of the system in greater detail.
Figure 5:
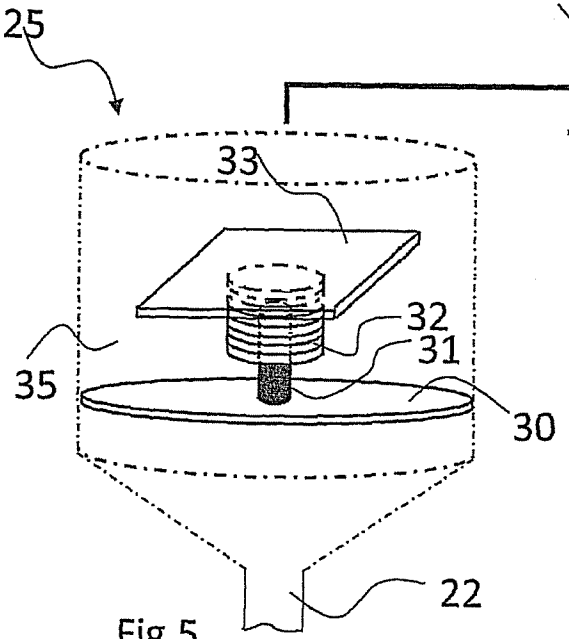

In the variant illustrated in this figure, the sensors are two pressure sensors communicating with respective linear pressure switches, one of which is shown in detail in FIGS. 4 and 5.

In this case, sensor 15 comprises a bell 20 whose open lower edge 21 is close to the bottom of tank 3; at its upper end, bell 20 communicates with a linear pressure switch 25 through a tube 22, preferably a hose.

Linear pressure switch 25 shown in detail in FIG. 5 is a per se known transducer, device which comprises a diaphragm 30 whose deformations, due to pressure variations which will be further discussed below, determine a linear movement of a ferromagnetic element 31, thereby altering the magnetic field of a coil 32 associated therewith and inducing a corresponding voltage signal.

Said signal is then processed in a per se known modulated form by an electronic circuit 33 associated with the coil, and is subsequently sent to control unit 14; in FIG. 5, the dashed-dotted line outlines housing 35 of pressure switch 25, wherein the various aforementioned components are arranged.

Linear pressure switches like the one described above are commercially available in Italy from ITW Metalflex, Invensys and Bitron. Of course, pressure switches of different types may be used as well, so long as they allow to detect pressure as explained below.

In fact, the liquid level within bell 20 changes with the liquid level in tank 3 (in FIG. 4 the surface of the washing agent in the bell is indicated by means of a dashed line). As a consequence, this causes a variation of the pressure of the air contained inside the bell, which is transmitted through tube 22 to linear pressure switch 25.

The latter detects these pressure variations and sends a corresponding modulated voltage signal of the PWM (Pulse Width Modulation) type to control unit U, which identifies the quantity of washing agent in the tank as a function of said pressure variations.

Alternatively, the output signal generated by linear pressure switch 25 and sent to control unit U is a frequency-modulated signal, since an oscillator circuit known in the art is associated with linear pressure switch 25.

The tank pressure measurement may be carried out by using a pressure sensor which provides either an absolute reading (i.e. which detects the absolute tank pressure value) or a relative reading (i.e. which detects pressure variations).

In principle, it is conceivable to measure the tank filling level by using a simple threshold meter, such as a float or the like, but it has been observed that the reading obtained by using a linear pressure switch 25 offers a number of advantages, which are mainly related to its relative construction simplicity and robustness. As a matter of fact, a float would require a number of mobile parts inside the tank, the operation of which might be altered by the high viscosity or chemical aggressiveness of washing agents, resulting in incorrect readings; by using a linear pressure switch, such problems can be prevented from arising.

The use of a linear pressure switch also allows to store a set of values pertaining to the progressive consumption of the washing agent into a memory unit (e.g. incorporated into control unit U itself), so that it is possible to know a consumption "trend" that allows to foresee in good approximation if the remaining quantity of washing agent will be sufficient for the next wash cycle.

In this manner, even if the tank is not completely empty but the washing agent level is clearly too low for one more wash cycle, it will be possible to activate the tank cleaning function.

A linear pressure switch can also be advantageous when simply used in combination with a washing machine, such as a laundry washing or washing/drying machine or the like, comprising a tub 1 housing a drum 2 in which the laundry to be washed is placed, wherein said machine is equipped with at least one tank 3,3' for a washing agent, to which tank at least one supply duct 6,6',8,8' is afferent for supplying the washing agent into tub 1, and wherein any variation of the level of washing agent inside tank 3,3' is detected by means of linear pressure switch 25.

A linear pressure switch can also be used to advantage for metering the washing agent: in fact, the latter is conveyed from the tanks to feedbox 9 and then released into tub 1 by means of a suction pump 7 fitted for each tank.

The quantity of each dose of washing agent is calculated automatically by control unit U that controls suction pump(s) 7, and may be either a fixed dose or, advantageously, a variable dose.

In the case of a variable dose, this can be calculated as a function of one or more parameters, such as: water temperature and hardness, type of cycle to be carried out, load type, dirtiness degree, load weight.

It is conceivable to provide, as a function of the readings obtained, a quantized volumetric metering of the detergent or a control feedback based on signals from physical and/or virtual sensors (e.g. a conductivity sensor in the wash tub, such as the one described in patent EP 582 329).

For this purpose, the washing machine is also equipped with sensors adapted to detect the above-mentioned parameters and to provide them to the control unit.

The sensors may be physical or virtual sensors; in this latter case, they are also called "software sensors" because they measure a quantity indirectly by means of readings of other quantities. For example, they can determine the type of clothes loaded in the drum depending on time and quantity of water absorbed by them.

It is also worth mentioning that, instead of taking place every time one tank is empty, the cleaning of the tanks may be carried out at preset intervals by concomitance with the emptying of the tank.

Should it be necessary to empty the tank prematurely when it is still partly full (e.g. because the washing agent used is not satisfactory), it is conceivable that the user activates manually the cleaning of the tank, which will thus be emptied and cleaned for receiving a new washing agent.

FIG. 3 also shows the shape of the two tanks and the size thereof in relation to the hydraulic circuit. As aforementioned, by using the teachings of the present invention it will not be necessary to limit or reduce the shape and dimensions (and hence the volume) of the tanks in order to make them removable, so that they may also extend rearwardly and laterally from the drum, thus providing a higher capacity.

Still with reference to FIG. 3, it should be pointed out that in this case as well, there is only one branch duct 12, and only one branch thereof 12A and 12A' used for both filling and draining tanks 3 and 3', which is beneficial in terms of construction and manufacturing simplicity.

In this instance as well, it is worth mentioning that it would also be conceivable to use one dedicated supply duct and one dedicated drain duct for conveying the water to and from the tanks in order to flood and drain them. But in such a case, the advantage of an extremely simple and low-cost hydraulic circuit, like the one offered by the solution described above, would be lost.

In this regard, it should be highlighted that single branch duct 12 having two branches 12A and 12A' afferent to two tanks 3, 3' in the example described herein may alternatively be replaced by two distinct branch ducts connected upstream of drain pump 13, each afferent to a respective tank 3, 3'.

The invention claimed is:

1. A washing machine, comprising:

a tub housing a drum into which laundry to be washed is loaded, the washing machine being equipped with at least one tank for a washing agent, and at least one supply duct being afferent to the at least one tank for delivering the washing agent into the tub;

at least one sensor configured to detect when the washing agent in the at least one tank has reached a particular level in the at least one tank;

a processor configured to determine whether an input device of the washing machine has been selected indicating that the at least one tank is to be cleaned and further configured to determine that the washing agent in the at least one tank has reached the particular level based on the sensor; and a hydraulic washing circuit configured to flood the at least one tank with liquid from the tub based on the processor determining that the washing agent has reached the particular level in the at least one tank or the processor determining the input device indicating that the at least one tank is to be cleaned has been selected.

2. The washing machine according to claim 1, wherein the washing machine comprises a drain duct fitted with a drain pump for draining the tub, and wherein the hydraulic washing circuit comprises a branch duct afferent to the drain duct in a region thereof located upstream of the drain pump, wherein the branch duct provides the liquid from the tub to the at least one tank.

3. The washing machine according to claim 2, wherein in response to flooding the at least one tank with the liquid from the tub, resulting residual liquid in the at least one tank is drained into a drain system utilizing the drain pump.

4. The washing machine according to claim 2, wherein a valve fitted to the branch duct is adapted to stop a flow in the branch duct, and wherein the drain pump is a volumetric pump.

5. The washing machine according to claim 4, wherein the at least one tank further comprises a cleaning port in fluid communication with the branch duct, a filler port for filling the at least one tank with the washing agent, and an air intake that puts the at least one tank in communication with an atmosphere.

6. The washing machine according to claim 5, wherein a suction pump is fitted to the supply duct and wherein the supply duct is afferent to a feedbox for delivering the washing agent into the tub.

7. The washing machine according to claim 4, wherein the valve fitted to the branch duct is driven by an actuator, that is a thermoactuator.

8. The washing machine according to claim 7, further comprising a control unit adapted to receive input signals transmitted by the linear pressure switch and to control the actuator of the valve.

9. The washing machine according to claim 1, wherein the level sensor is configured for detecting variation of levels of the washing agent inside the at least one tank.

10. The washing machine according to claim 9, wherein the level sensor comprises a bell having an open lower edge lying near a bottom of the at least one tank, and wherein the bell communicates with a linear pressure switch through a tube.

11. The washing machine according to claim 1, comprising two washing agent tanks, wherein the washing machine also comprises a drain duct fitted with a drain pump for draining the tub, and wherein the hydraulic washing circuit comprises at least two branches afferent to the drain duct in a region thereof located upstream of the drain pump, each of the at least one branches being in fluid communication with one of the two washing agent tanks, and wherein to each branch a valve is fitted which is adapted to stop a flow in the branch, each of the valves being driven by a respective actuator that is a thermoactuator, each washing agent tank being provided with a level sensor for detecting variation of a level of the washing agent contained therein, each level sensor including a bell having an open lower edge lying near a bottom of the tank, which communicates with a respective linear pressure switch through a tube.

12. The washing machine according to claim 1, wherein when the washing agent in the at least one tank has reached the particular level in the at least one tank or the processor determining the input device indicating that the at least one tank is to be cleaned has been selected, the hydraulic washing circuit configured to open a valve of a branch duct connecting the tub and the at least one tank is opened to flood the at least one tank with the liquid from the tub.

13. A washing machine, comprising:

a tub housing a drum into which the laundry to be washed is loaded, the machine being equipped with at least one tank for a washing agent, at least one supply duct being afferent to at least one tank for delivering the washing agent into the tub, wherein variation of a level of the washing agent in the at least one tank is detected through a sensor;

a processor configured to determine that the washing agent in the at least one tank has reached a particular level based on the sensor;

a branch duct configured to flood the at least one tank with liquid from the tub based on the processor determining that the washing agent has reached the particular level in the at least one tank; and a drain pump configured to drain resulting residual liquid in the tank, after flooding the tank, to a draining system.

14. The washing machine according to claim 13, wherein the level sensor comprises a bell having an open lower edge lying near a bottom of the at least one tank, and wherein the bell communicates with a linear pressure switch through a tube.

15. A washing machine, comprising:

a tub housing a drum into which the laundry to be washed is loaded, the machine being equipped with at least one tank for a washing agent, at least one supply duct being afferent to the at least one tank for delivering the washing agent into the tub, wherein variation of a level of the washing agent in the at least one tank is detected through a sensor;

a processor configured to determine whether an input device of the washing machine has been selected indicating that the at least one tank is to be cleaned and further configured to determine that the washing agent in the at least one tank has reached a particular level based on the sensor; and a branch duct configured to flood the at least one tank with liquid from the tub based on the processor determining that the washing agent has reached the particular level in the at least one tank or the processor determining the input device indicating that the at least one tank is to be cleaned has been selected.

* * * * *